United States Patent [19]

Mori

[11] Patent Number: 4,718,500

[45] Date of Patent: Jan. 12, 1988

[54] REVERSIBLE PERCUSSION DEVICE FOR PERCUSSION TOOL

[75] Inventor: Masami Mori, Machida, Japan

[73] Assignee: Ingersoll-Rand Company, Woodcliff Lake, N.J.

[21] Appl. No.: 825,212

[22] Filed: Feb. 3, 1986

[51] Int. Cl.[4] ..... B25D 9/04

[52] U.S. Cl. ..... 173/132; 173/91

[58] Field of Search ..... 173/91, 116, 132, 133, 173/104, 105

[56] References Cited

U.S. PATENT DOCUMENTS

| | | | |
|---|---|---|---|
| 4,366,868 | 1/1983 | Salmi | 173/132 |
| 4,446,930 | 5/1984 | Nilsson et al. | 173/91 |
| 4,582,145 | 4/1986 | Salmi et al. | 173/132 |
| 4,596,292 | 6/1986 | Crover | 173/91 |

*Primary Examiner*—Paul A. Bell
*Assistant Examiner*—James L. Wolfe
*Attorney, Agent, or Firm*—W. C. Vliet

[57] ABSTRACT

A fluid impact tool of the type known as a percussion or rock drill characterized by a percussion mechanism which provides alternative reverse percussion to assist in drill string removal or recovery.

8 Claims, 2 Drawing Figures

REVERSIBLE PERCUSSION DEVICE FOR PERCUSSION TOOL

BACKGROUND OF THE INVENTION

The present invention relates to a percussion drill such as a rock drill, and more particularly, an apparatus for withdrawing a drilling rod of a rock drill and the like.

In spite of the fact that average drilling and rod recovering time in drilling of a hole of 3 inches (75 mm) diameter and 39 feet (12 m) depth has been reduced to approximately 15 minutes at places where the lithology is relatively uniform and good, there is also known occasions where only one hole can be drilled in a day. Such poor efficiency is usually caused by occurence of a jammed or clogged drill hole.

Accordingly, it is an object of the present invention to provide a percussion device for a tool such as a rock drill, said device contributing to improve the working efficiency of drilling by withdrawing a drilling rod without the influence of jamming.

It is another object of the present invention to provide a percussion device for a tool such as a rock drill, which device eliminates the need of means for preventing jamming of a drilling machine or simplifies said means and can lighten the mental load of operators.

These and other objects are obtained in a percussion tool having a machine housing, a main piston reciprocated within the machine housing by fluid pressure, and an anvil element exerted with a first impact thereon by the forward movement of the main piston, and adapted to exert a second impact on the anvil element in the direction opposite to that of the first impact, a reversal percussion device, for the percussion tool comprising a source of pressurized fluid for supplying pressurized fluid, a buffer chamber receiving the pressurized fluid, a machine housing constituting a portion of the buffer chamber, and a secondary piston constituting a portion of the buffer chamber and sliding to allow the volume of the buffer chamber to be varied, the secondary piston having a piston surface limiting the axial portion of the buffer chamber near the main piston.

In the present invention, jammed rod withdrawal is made possible by an impacting piston imparting impacts on a shank rod simultaneously with application of a conventional mechanical pulling force on the rock drill. Impact energy transmitted to the shank rod by the impacting piston is recovered so that impact pressure is averaged over a certain time by a secondary piston and an accumulator, and following retraction of the impacting piston, the secondary piston and the shank rod is instantaneously pushed back in the reverse direction.

This means that impact pulses in the directions in which a working tool is compressed and pulled, are alternately exerted on a working tool such as a shank rod, a rod and a bit. Therefore, rod withdrawal which was so far difficult can be easily performed in a short time. This permits substantial reduction of working time.

DESCRIPTION OF THE PREFERRED EMBODIMENT

Figure 1:
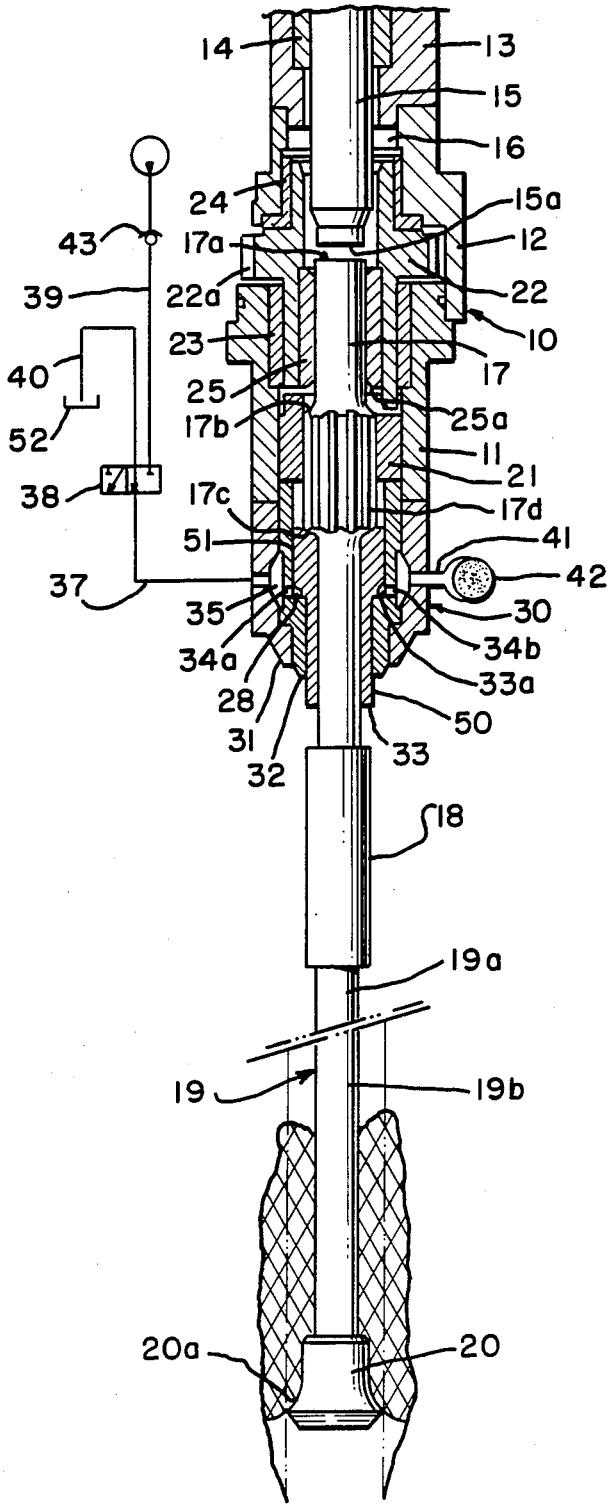
FIG. 1 is a sectional view showing the front of a rock drill incorporated with a reversal percussion device in accordance with the present invention.
Figure 2:
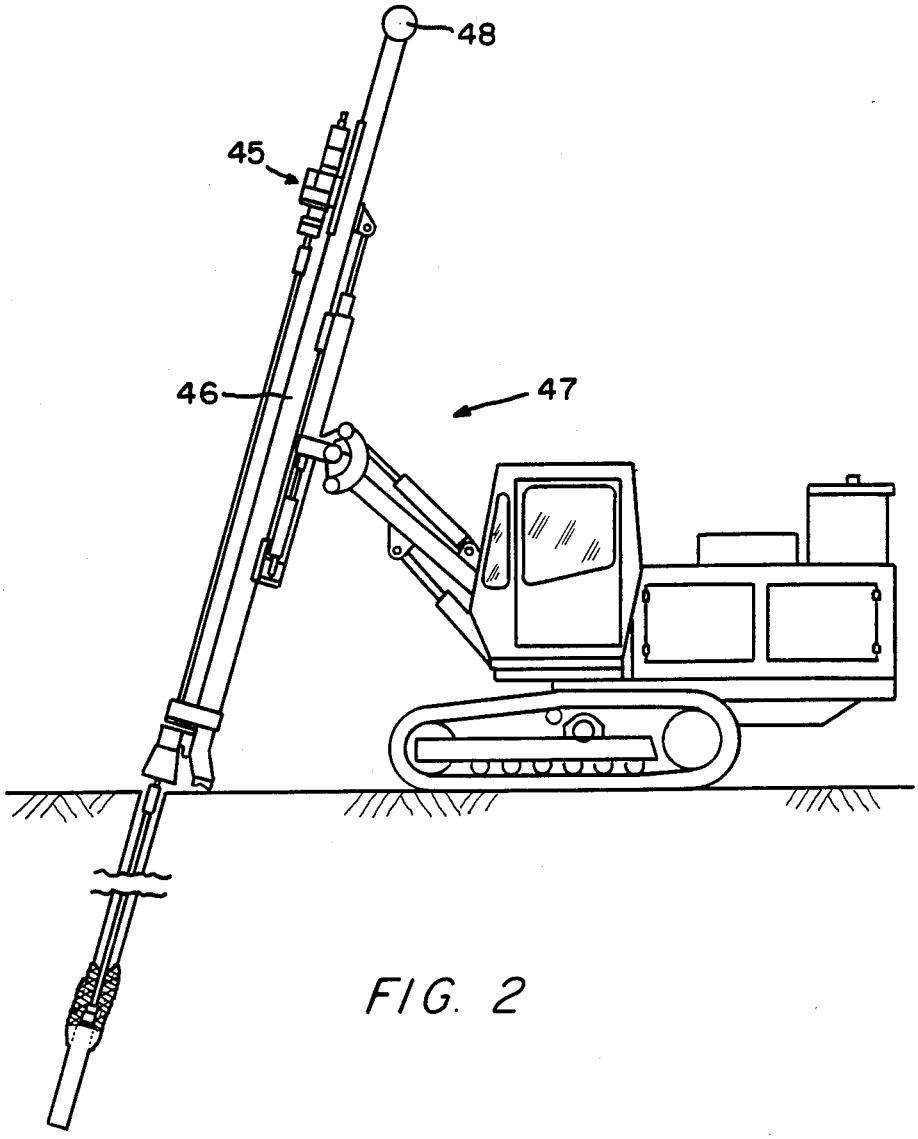
FIG. 2 is a general view of a drifter equipped with a rock drill including the reversal percussion device in accordance with the present invention.

Referring now to FIG. 1, a rock drill comprises a machine housing containing therein a front head 11, a gear housing 12, a cylinder case 13 and a main piston cylinder 14. A main piston 15 is reciprocated within the main piston cylinder 14 by fluid pressure. The main piston 15 has an impacting surface 15*a* and is disposed to provide a shock to a shank rod (or anvil element) 17 through forward motion. The shank rod 17 has a surface 17*a* to be impacted by the main piston, a surface 17*b* limiting a retracted position relative to the rock drill, and a surface 17*c* limiting an advanced position relative to the same. The shank rod 17 has a drilling rod 19*a* connected through a sleeve 18 and a front drilling rod 19*b* has a bit 20 connected thereto.

A rotary chuck 21 is connected to the shank rod 17 so as to rotate with a chuck driver 22, which has a ring gear 22*a* engaging a gear connected to a driving source not shown. The rotary chuck 21 is arranged so that its axial movement within the machine housing is prevented, and engages the shank rod 17 by a spline 17*a*. Thus, the shank rod 17 is forceably rotated through action from the driving source, and is axially movable relative to the rotary chuck 21. The chuck driver 22 is supported with a bearing 23 and a thrust bearing 24 so as to rotate at a normal position in the machine housing 10, and has a thrust bearing member 25 pressed in against the inner cylindrical surface of the chuck driver 22, said member 25 limiting a retracted position of the shank rod 17 in the rock drill.

A machine housing 30 constituting part of buffer chamber 28 includes a front head cap 31 and a reverse cylinder 32. The buffer chamber 28 is connected to a directional control valve 38 through a passage 34*a*, an annular space 35 and a conduit 37. The directional control valve 38 can be selectively connected to a conduit 39 connected to the source of pressurized fluid through a check valve 43 and to a conduit 40 connected to a reservoir 52. The check valve 43 permits flow from the source of fluid to the check valve 38, but prevents a return flow.

An accumulator 42 is always connected to the buffer chamber 28 through a passage 41, the annular space 35 and a passage 34*b*.

A reverse piston (secondary piston) 33 has an outer reduced diameter cylindrical surface 50 and an outer enlarged diameter cylindrical surface 51 each disposed slidably relative to the inner cylindrical surface of the reverse cylinder 32, said reverse piston 33 moving backward relative to the reverse cylinder when pressurized fluid in the buffer chamber acts on the stepped portion between the reduced and enlarged diameter cylindrical surfaces, or a piston surface 33*a*.

Also, the piston surface 33*a* of the reverse piston 33 provides a surface limiting the forward movement of the piston 33. Furthermore, the design of the reverse piston 33 is such that when the reverse piston 33 is located at the most advanced position relative to the reverse cylinder 32, a force applied to part of the piston surface 33*a* which may form the buffer chamber by pressure oil from the source of pressurized fluid is larger than the maximum pulling force applied to the rock drill to move it backward.

A conduit communicating with a lubricator (not shown) is connected to a cavity 16 in the machine housing 10 of the rock drill, said conduit supplying oil mist by compressed air during operation of the rock drill. The compressed air, after lubricating slidable members, is discharged through a gap between the inner surface of the reverse piston 33 and the outer surface of the shank rod 17. This, at the same time, keeps the cavity 16 in the housing 10 at a constant pressure and prevents entering of dust from the exterior.

The rock drill 45 is moved up and down on a drill guide 46 of a drifter 47 by an endless chain connected thereto through a feed motor 48.

Operation of the reversal percusion device will now be described. In FIG. 1, after completing of drilling, pulling force acts on the surface 17*c* of the shank rod through the machine housing 10 of the rock drill, the front end cap 31, the reverse cylinder 32, and the reverse piston 33. The buffer chamber 28 is connected to a tank port while the reverse piston 33 and the shank rod 17 is located at the front of the rock drill. That is, the impacted surface 17*a* of the shank rod is located farther onward than the front at which the impacting surface 15*a* of the main piston is located during its reciprocating cycle. Therefore, the main piston 15 cannot impact the shank rod 17. This is the same as prior art rock drills.

Now, when pulling force applied to the rock drill becomes impossible to pull the drilling rod 19, that is, when jamming occurs, upon switching the directional control valve 38 to connect the conduit 37 to the conduit 39, pressure oil supplied from the source of pressurized fluid enters the buffer chamber 28 and pressurizes the accumulator 42. Then, when fluid pressure acting on part of the reverse piston's piston surface 33*a* forming the buffer chamber reaches a value larger than a pulling force being applied to the rock drill to move it backward, the rock drill, except for the reverse cylinder 33 and the shank rod 17, begins to move forward, that is, toward the drilling rod's side and the surface 25*a* of the bearing member 25 is put into contact with the shank rod's surface 17*b*. At this time, the impacted surface 17*a* of the shank rod is located at the normal position in the drilling work of the main piston 15. When the main piston is operated in this situation, the main piston 15 impacts the impacted surface 17*a* of the shank rod and then turns to a backward movement. The shank rod 17 moves forward together with the sleeve 18, the drilling rod 19, the bit 20, and the reverse piston 33. At this time, pressure oil in the buffer chamber enters the accumulator 42 through the passage 41. The accumulator 42 effectively absorbs impact energy transmitted to the shank rod 17 through the reverse piston 33. Thus, the reverse piston 33 gradually slows down and stops.

On the other hand, the pulling force applied to the machine housing of the rock drill loses a reaction force balancing therewith and moves the rock drill backward as soon as the shank rod's surface 17*b* separates from the surface 25*a* of the bearing member, that is, the rear surface 20*a* of the drilling bit 20 separates from bodies jamming the drilled hole. Therefore, when the reverse piston 33 terminates its forward motion, the accumulator 42 sends out the accumulated pressure oil to the buffer chamber 28 to instantaneously let off the reverse piston 33 backward. The reverse piston 33 instantaneously moves backward together with the shank rod 17, the sleeve 18, and the drilling bit 20, and after the drilling bit's surface 20*a* impacts the bodies jamming the drilled hole, the shank rod's surface 17*b* is fixed to the surface 25*a* of the bearing member and the movement of the reverse piston 33 is terminated to wait the next impact of the main piston.

When operation of the reversal percussion device is intended to be terminated, the directional control valve is switched to cause the conduit 37 to communicate with the conduit 40. Therefore, oil accumulated in the accumulator is returned to the reservoir and at the same time oil in the buffer chamber is also returned to the reservoir since the reverse piston 33 is advanced by the lubricator's supply pressure which is acting on the rear end surface of the reverse piston 33 including the reverse piston's surface 17*c*. And, the reverse piston stops at the position where part of the surface 33*a* makes contact with the reverse piston, and permits a drilling work similar to that of the conventional rock drill.

According to the present invention, since even in drilling work at the place where the lithology is bad, drilling and withdrawal of drilling rods can be performed in a single operation without paying attention to jamming, the total impacting time is substantially reduced, and at the same time, the duration of vibration caused by impact and given to surroundings such as a drilled wall is also reduced, and therefore, a relatively solid drilled wall surface can be left.

I claim:

1. In a percussion tool having a housing, a main piston reciprocated within a main piston cylinder within said housing by fluid pressure, an anvil element exerted with a first impact thereon by the forward movement of said main piston, said anvil element being further exerted with a second impact on said anvil element in the direction opposite to that of the first impact, said second impact being produced by a reverse percussion device comprising a source of pressurized fluid for supplying pressurized fluid, a buffer chamber receiving said pressurized fluid, a reverse cylinder constituting a first portion of said buffer chamber and a secondary piston constituting a second portion of said buffer chamber in sliding relationship to said anvil element and to said reverse cylinder to allow the volume of said buffer chamber to be varied, said secondary piston having a surface limiting the axial displacement of said anvil element in response to expansion of said buffer chamber upon introduction of said pressure fluid into said buffer chamber whereby said anvil element impacts said secondary piston and is in turn impacted thereon by reaction of said secondary piston in reverse.

2. A device as claimed in claim 1 including an accumulator connected to the buffer chamber.

3. A device as claimed in claim 2 including a conduit which can selectively connect the buffer chamber to the source of pressurized fluid when the reversal percussion device is operated.

4. A device as claimed in claim 3 wherein the percussion tool is a rock drill including a housing adapted to transfer a forward driving force to said anvil element, and the percussion tool is disposed in a way that when the rock drill is applied with a forward driving force or a backward pulling force, said buffer chamber is moved forward or backward as a unit with or in the interlocked relationship to a housing constituting a rock drill.

5. A device as claimed in claim 4 wherein the magnitude of force produced by the pressurized fluid acting on the piston surface of the secondary piston constituting a portion of the buffer chamber is such that it becomes larger than a pulling force which may be applied on the housing of said rock drill when the reverse percussion device is operated.

6. A device as claimed in claim 5 wherein the percussion tool is a rock drill including means for rotating said anvil element, and the pressurized fluid within said secondary piston and said buffer chamber forms a thrust bearing for the rotating anvil element when the buffer chamber is connected to the source of pressurized fluid.

7. A device as claimed in claim 6 wherein said anvil element has a surface limiting its positions to be retracted and advanced relative to the rock drill, and said secondary piston is operated to fixedly join the anvil element to the thrust bearing portion within the housing of the rock drill, said thrust bearing portion limiting the retracted position of the anvil element.

8. In a percussion tool having an anvil element, a machine housing connected to the anvil for transmitting a driving force in the direction of action (forward), and a main piston reciprocated within the machine housing by a fluid pressure to transmit a first impact to said anvil element, said tool transmitting a second impact to the anvil element in the reverse direction relative to the first impact, a reversal percussion device comprising:

a source of pressurized fluid for supplying a pressurized fluid, a buffer chamber receiving the pressurized fluid, a conduit which can selectively connect the buffer chamber to the source of pressurized fluid, a reversal piston having a piston surface forming a portion of the buffer chamber and limiting the axial portion of the buffer chamber near the main piston, said secondary piston being able to fixedly connect the surface to be impacted by the main piston in said anvil element to the normal impacting surface of the main piston when the buffer chamber is connected to the source of pressurized fluid, the area of the piston surface of the secondary piston which surface forms a portion of the buffer chamber and the magnitude of the pressure of pressurized fluid are selected so that their product is larger than a pulling force exerted on the machine housing in the direction of reaction, spring means connected to the buffer chamber for accumulating the impulse pressure of the pressurized fluid acting on the piston surface of the secondary piston when the main piston impacts the anvil element, and instanteously releasing the accumulated pressure when the main piston is retracted, thereby actuating the secondary piston so as to transmit an unimpeded second impact to the anvil element in the direction reverse to the first impact.

* * * * *